United States Patent [19]

Johannsen

[11] 4,159,183

[45] Jun. 26, 1979

[54] KEYBOARD EMPLOYING PHOTOELECTRIC KEY ACTUATION SENSING

[75] Inventor: Fred Johannsen, Varel, Fed. Rep. of Germany

[73] Assignee: Olympia Werke AG, Wilhelmshaven, Fed. Rep. of Germany

[21] Appl. No.: 847,738

[22] Filed: Nov. 2, 1977

[30] Foreign Application Priority Data

Nov. 2, 1976 [DE] Fed. Rep. of Germany ..... 2650308

[51] Int. Cl.[2] ..... B41J 5/08

[52] U.S. Cl. ..... 400/477; 400/496; 400/490; 235/145 R; 340/365 P; 400/478; 178/17 D

[58] Field of Search ..... 400/472, 477, 478, 479, 400/496, 694; 235/145 R; 340/365 P; 178/17 C, 17 D

[56] References Cited

U.S. PATENT DOCUMENTS

| | | | |
|---|---|---|---|
| 3,017,463 | 1/1962 | Dinsmore et al. | 235/145 R X |
| 3,495,239 | 2/1970 | Glorioso et al. | 340/365 P |
| 3,579,047 | 5/1971 | Sturm et al. | 340/365 P |
| 3,609,713 | 9/1971 | Wooton et al. | 340/365 P |
| 3,617,627 | 11/1971 | McLean | 235/145 R X |
| 3,633,723 | 1/1972 | Kosters | 400/496 X |
| 3,750,150 | 7/1973 | Cramer et al. | 400/477 X |
| 3,767,022 | 10/1973 | Olson | 400/490 X |
| 3,777,155 | 12/1973 | Cramer et al. | 340/365 P X |

*Primary Examiner*—Ernest T. Wright, Jr.
*Attorney, Agent, or Firm*—Spencer & Kaye

[57] ABSTRACT

In a key-operated machine in which actuation of a key moves code elements of an associated code card into the path of a photoelectric sensing system, each code card is moved by a drive mechanism so as to cause the code elements to traverse the sensing system path only once, and at a speed which is independent of the speed of key movement, in response to each key actuation.

9 Claims, 4 Drawing Figures

KEYBOARD EMPLOYING PHOTOELECTRIC KEY ACTUATION SENSING

BACKGROUND OF THE INVENTION

The present invention relates to a keyboard for use in a typewriter or similar office machine the keyboard being of the type provided with a plurality of keys each having an associated code card or mask provided with apertures defining light paths.

In a keyboard of the type contemplated by the invention, each code card is actuated by a drive mechanism in response to actuation of its associated key so that the card performs a switching movement which temporarily blocks or opens beam paths between light sources and light sensors, the switching movement occurring at a speed which is independent of the manner in which the key is actuated and taking place only one time through the beam paths in response to each key actuation.

Such a keyboard, which is used in conjunction with a teletype machine and one example of which is disclosed in the periodical "elektronik aktuell" [present-day electronics] No. 1/1976, is composed essentially of individual interchangeable components which can be inserted into a keyboard frame. Each individual component includes a plurality of individual parts. The most important operating parts of these individual key components include: an over-the-center leaf spring, a packet of two springs being required for each key component to provide optimum efficiency, which is acted upon substantially in the longitudinal direction by a key element, such as a key shaft, and which is capable of bistably assuming either one of two positions; and a mask which is acted upon by the leaf spring to effect a snap-action movement and which cooperates with a stationary coding plate. The coding plate is formed by a two-part receiving insert and one such plate is provided for each key, the mask being guided between the two parts of the insert. These receiving inserts for all of the coding plates are distributed over the entire width of the keyboard to form, together with perforations, the beam paths between the light sources and light sensors.

Such a known optically coded keyboard, which improves the operation of a prior art optical keyboard of the type disclosed in German Auslegeschrift No. 2,135,440, and British Pat. No. 1,340,305, with respect to noise and switching speed, achieves the purpose for which it was created, according to which the snap mask, which may constitute either a coding slide or a covering slide, is to intersect the beam paths only once during each key actuation and is to undergo a control movement which is independent of the speed and duration of the manual key actuation, the control movement always being effected at approximately the same speed. However, it still has certain drawbacks which will be explained in detail below.

In addition to the fact that the large number of individual parts required for such a keyboard cause its manufacturing and installation costs to exceed acceptable levels for economical electric office typewriters, it also has operational features which do not seem to make it optimally applicable for use in normal correspondence typewriters. The packet of over-the-center leaf springs, which in the production state is linear and in the installed state is clamped in a bowed form, is deformed by laterally arranged supporting tongues, when a key is manually actuated in the longitudinal direction, so that it takes on an S shape and the point of contact of the leaf spring packet is displaced along the supporting tongues. Then, after gradually passing over a dead point, the packet of leaf springs switches over to an arcuate form with a curve in the other direction and thus displaces the snap mask through the beam paths. The result is that the time of the snapping movement of the snap mask is not dependent solely upon the actuating stroke of the key, but is mainly dependent on the accuracy of the positioning of the supporting tongues and on the tensioning state of the leaf spring packet. A depth movement of the key element which is uniform for both directions of snap of the snap mask is therefore realizable only if the leaf spring packet is absolutely linear in the production state, this being necessary to produce identical tensioning forces in the packet for both stable positions in the installed state. However, such precise manufacture of a leaf spring packet is very difficult to attain on a mass production basis.

Moreover, sensitive users of such a known keyboard often consider it a drawback that the leaf spring packet, which for every actuation of a key performs only one snapping movement, can naturally emit only one response signal to be noted by touch or ear as a confirmation that the particular function has been actuated, i.e. when the key is being depressed. However, users who utilize the keys of a keyboard as resting points for their fingers when the keys are in the raised rest position, which helps to increase their typing speed, often require a similarly noticeable signal as an indication that the key has returned to the raised rest position and is therefore available for renewed function actuation.

SUMMARY OF THE INVENTION

It is an object of the present invention to provide an improved keyboard of the type described above in which the movement of the key is more independent of the inherent behavior of the leaf spring itself, so that the operator is provided with an improved response signal control, and in which the keyboard as a whole is simpler to manufacture.

This and other objects according to the invention are achieved, in a keyboard composed of a plurality of key elements arranged to be individually actuated, an actuation sensing unit composed of a plurality of light emitters producing light beams extending along parallel paths and a plurality of detectors each disposed at the end of a respective light beam path, a plurality of coded masks each associated with a respective key element and each movable into an operational position where it blocks at least one beam path to provide a selected pattern of light beam interruptions that identifies its associated key element, and a drive mechanism connected between each key element and its associated mask for moving a mask through its operational position in response to actuation of its associated key element, by the improvement wherein, for each mask, there is provided a guide member secured to the mask, and a stationary counterguide surface cooperating with the guide member for causing the mask to be displaced, under the action of the drive mechanism in response to actuation of its associated key element, over a closed path having a first portion along which the mask moves through its operational position and a second portion which is displaced from the first portion.

In preferred embodiments of the invention, each key element can be manufactured, together with its associated drive mechanism and coded mask, as a one-piece component.

Compared to the keyboards of the prior art, the present invention has the significant advantage that, aside from the key button, or key top, all parts contributing to the performance of a snapping movement of the snap mask, or slideable code card, can, in preferred embodiments, be made by injection molding of suitable plastic materials. Each code card is provided with code elements, for example light-blocking tongues, a selected one or plurality of which are deleted to effect coding. According to the invention, all code cards can initially be structurally identical, i.e. provided with a full set of tongues capable of being individually broken off. This facilitates installation by unskilled personnel since the coding of the entire keyboard, which must be adapted to the particular installation, e.g. the language for which the machine is to be used, can be effected in a single operation by means of appropriately designed tools after the key elements have been installed.

Generally, the arrangement of the guide means and the counterguide means in the region of movement of the code card has the ingenious result of enabling the code card to be brought into a ready position, for example by a vertical movement with respect to the light beam paths, without covering the beam paths with its code elements. During this phase of actuation of a key element, the drive means, for example a spring, for producing the snapping movement of the card is tensioned. Then, when the card has reached the lower actuating position and has been released by the guide means, the drive means effect an input snap movement, for example in the horizontal direction. During the subsequent return movement of the key element into its upper starting position, the card passes over a different portion of the closed geometric path and returns to its rest position under the effect of the driving means, by undergoing, for example, a horizontal snapping movement.

Keyboards employing photoelectrically detectable code elements are known, for example as disclosed in U.S. Pat. No. 3,767,022, in which the individual key mechanisms can be produced easily by means of modern plastic injection molding techniques, but these keyboards employ a different type of photoelectric detection in which the duration of actuation of the light-sensitive elements depends on the duration of keyboard actuation and which require considerably more electronic control devices and are therefore not really suitable for use with correspondence typewriters which must be capable of sensing very light key pressures in rapid succession.

DESCRIPTION OF THE PREFERRED EMBODIMENTS

Figure 1:
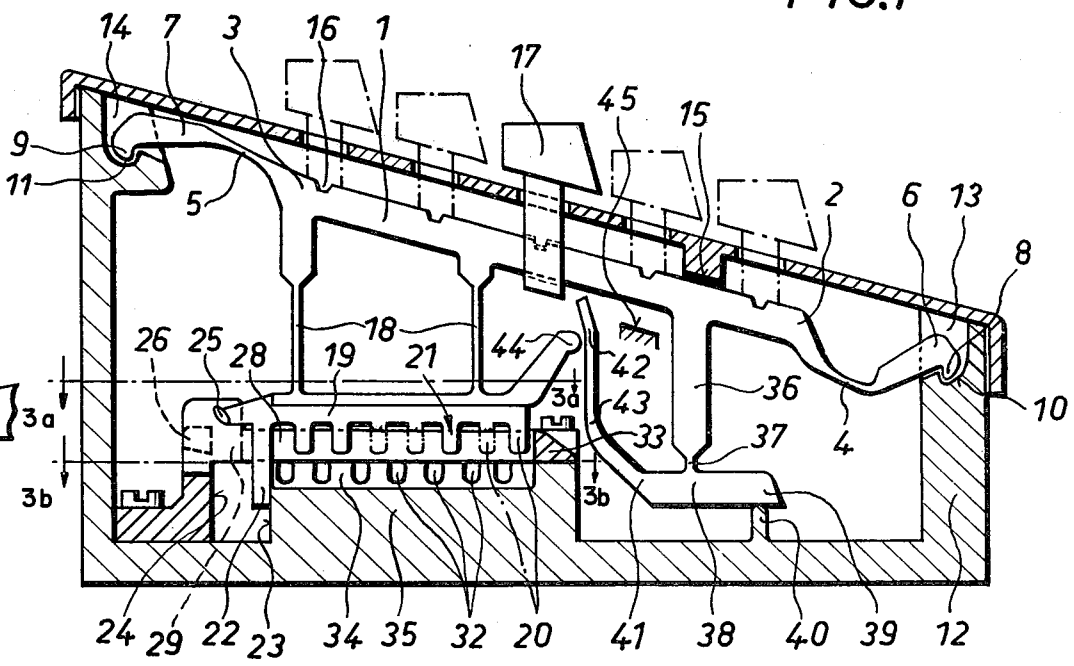
FIG. 1 is an elevational, cross-sectional view of a preferred embodiment of a keyboard according to the invention.

FIG. 1 shows a keyboard composed of a plurality of key elements 1, one of which is shown. Each element 1 can be produced integrally with associated bearing components 6, 7, 8, and 9, code card 19 and drive mechanism 18, 36–38, 41, 43 by a plastic injection molding process. The portion of such a one-piece member which constitutes key element 1 proper is rigid and extends across all of the rows of keys provided on the keyboard. The ends 2 and 3 of element 1 are connected via film hinges 4 and 5, respectively, to bearing guides 6 and 7, respectively. Each bearing guide 6 and 7 has a bearing tongue 8 or 9, respectively, via which each guide 6 and 7 is pivotally mounted in a respective bearing depression, or recess, 10 or 11. The bearing depressions 10 and 11 are each formed in the bottom surface of a respective guide slit 13 or 14 provided in the keyboard frame 12.

Bearing guides 6 and 7 are configured and dimensioned for causing key element 1 to undergo, upon actuation of its associated key button 17, a substantially non-rotational, translational movement along a substantially linear path. In the installed state of key element 1, hinges 4 and 5 are in a slightly spring tensioned state so that the key element 1 can take on an exact rest position against an abutment 15 of keyboard frame 12. This abutment 15 is preferably located between the two bearing depressions 10 and 11.

Each key element 1 has a plurality of detent notches 16 each aligned with a respective row of keys so that each element 1 can be associated with a key in any row by securing a key button 17 in the selected row to the associated notch 16 by effecting a click-in attachment at the selected location.

The key element 1 is provided with two downwardly extending spring bars 18 by which it is integrally connected to a slidable code card 19 which acts as a mask. These spring bars 18, which act as connecting means and also as the first spring means for resetting the card 19 into the rest position shown in FIG. 1, are connected to card 19 to form a parallelogram linkage between element 1 and the card 19 so as to cause the card 19 to undergo a translational movement relative to element 1 in a direction transverse to the direction of actuation and a movement together with element 1 in the direction of actuation of element 1. To this end, the spring bars 18, which are part of the driving device for the mask 19, are formed to be stiff, i.e. to not undergo any flexing, in the actuation direction of key element 1.

Code card 19 is provided with downwardly extending blocking tongues 20 each provided with a predetermined break-away point 21 at its base, for example in the form of a region of reduced cross section. Furthermore, code card 19 is provided with a displacement limiting abutment 22 which in the installed state of the key element 1 is disposed between two abutments 23 and 24 fixed to the keyboard frame 12. These abutments 23 and 24 which extend across the entire width of the keyboard, i.e. perpendicular to the plane of FIG. 1, and are thus effective for all key mechanisms, serve to delimit respectively, the rest position of the code card 19, shown in FIG. 1, or the maximum snap position of the card 19, which is to the left of that shown in FIG. 1.

Figure 2:
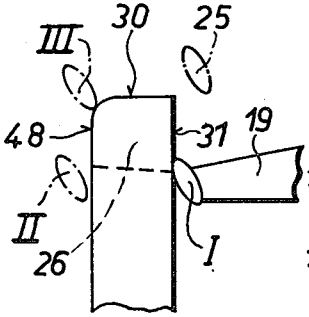
FIG. 2 is a detail view of a portion of the structure of FIG. 1.
Figures 3A, 3B:
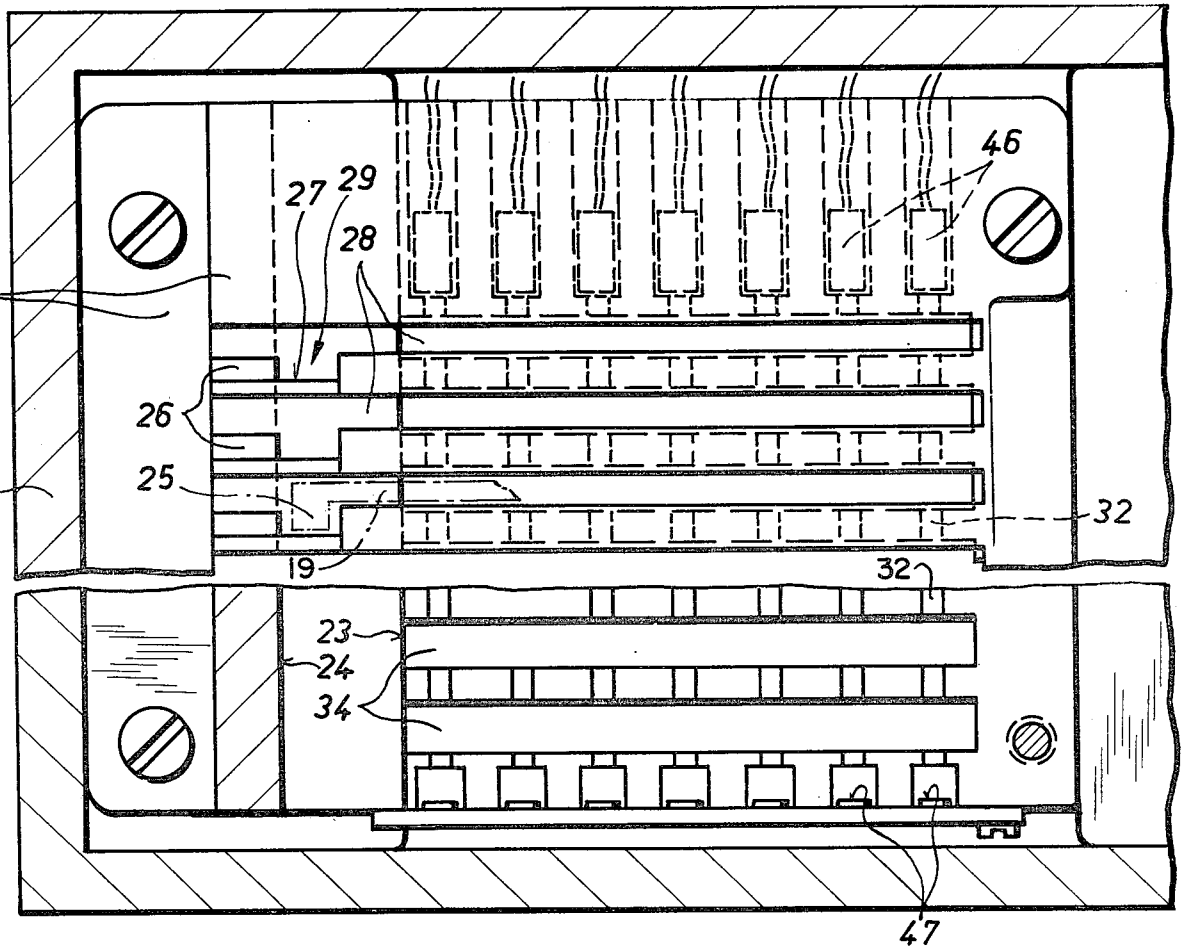
FIG. 3*a* is a cross-sectional view along line 3*a*—3*a* of FIG. 1 with the drive mechanism removed.
FIG. 3*b* is a cross-sectional view along line 3*b*—3*b* of FIG. 1, with the drive mechanism removed.

At the left end of card 19 there is provided a control tongue 25 which projects laterally from the card 19, as shown in FIG. 3*a*, and which is shaped to act as a guide means for the movement of the card 19. Tongue 25 preferably has the form of an oval whose major axis is oblique to the direction of movement of card 19 relative to key element 1. Tongue 25 is disposed to cooperate with a counter guide means defined by a protrusion 26 at the side of one wall 27 (see in particular FIG. 3*a*) of a guide groove 28 provided for receiving card 19. This protrusion 26 is located in a region 29 which is made much wider than the rest of groove 28 and which receives the control tongue 25. The protrusion 26 has essentially a rectangular shape and is located with respect to control tongue 25 so that, referring to FIG. 2, in the rest position of key element 1 and card 19, tongue 25 comes to lie above the upper horizontal edge 30 and in front of the right vertical edge 31 of protrusion 26.

The counter guide means, which are preferably in the form of the protrusion 26 and around which the control tongue 25 of card 19 can move mainly under the influence of spring means, to be described below, on a path which is practically a closed geometric curve, may also be designed as a groove, for example, to effect a positive guidance of the control tongue 25. The shape of the counter guide means may also, if necessary, deviate from a rectangular form. However, this would require a longer actuation path for the key element 1 and a longer snap movement path for the code card 19.

The dimensions of protrusion 26 are dependent on the dimensions of, and spacing between, the light beam paths defined by stationary openings 32, to be described below, which beam paths must temporarily be completely blocked by masking tongues 20 of code card 19 during each snap movement toward the left.

As can be seen in FIGS. 1 and 3*a*, the guide grooves 28 for guiding all code cards 19 are formed in a cover plate 33 which also presents the abutment 24 for the bars 22. The cover plate 33, which is associated with the keyboard frame 12, is fastened to a bar 35 which presents the beam path defining openings 32 and which has grooves 34, extending parallel to, and below, guide grooves 28, for receiving tongues 20, grooves 34 intersecting the beam paths defined by openings 32. Bar 35 forms part of keyboard frame 12, and its left-hand face defines the rest abutment 23 for bar 22.

A two-armed lever 38 is joined to element 1 by means of a rigid bar component 36 and a film hinge 37, lever 38 and its elements 36 and 37 preferably being formed integrally with element 1. The first arm 39 of lever 38 extends horizontally, i.e. transversely to the direction of actuation of key element 1, when the key element 1 is in its rest position, and bears directly upon a supporting edge 40 which forms part of keyboard frame 12 and extends across the width of the frame 12 to cooperate with all key mechanisms. The second arm 41 of lever 38 is formed as a bar-like leaf spring 43 which is part of the driving means for card 19 and which extends substantially vertically to act as a second spring means for the code card 19. This leaf spring 43 has its free end 42 disposed opposite a displacement tongue 44 integral, and forming a rigid unit, with card 19. In the rest state of element 1 and card 19, a small space exists between spring end 42 and tongue 44. Leaf spring 43 is much stronger than both spring bars 18 together.

If any selected key is actuated manually, by depressing its associated button 17, in order to introduce a coded function representing a character into the office machine, the associated key element 1 moves downwardly against the spring action of its film hinges 4 and 5. This also moves card 19 downwardly in parallel with element 1. Thus, the control tongue 25 which is effective as a guide means comes into the region of the vertical edge 31 of protrusion 26 which is effective as counter guide means. At the same time lever 38 is pivoted counterclockwise about its fulcrum, film hinge 37, due to the effect of the supporting edge 40 so that the action of its leaf spring 43 on card 19 via its tongue 44 is delayed for a short time by engagement of tongue 25 against edge 31. However, spring 43, which acts as the second spring means of the driving mechanism, exerts a continuously increasing displacement force in the direction toward protrusion 26 as key element 1 continues to be depressed. Since card 19 is prevented from moving toward the left by protrusion 26, its control tongue 25 slides vertically downwardly along edge 31 so that the displacement force is being stored in leaf spring 43.

If the control tongue 25 is released from edge 31, just below position I in FIG. 2, shortly before key element 1 reaches the end of its actuation travel, which may be defined, for example, by an abutment edge 45, card 19 is free to move to the left and is therefore caused to undergo a snap movement in that direction by the displacement force generated by spring 43. As a result of this movement, spring bars 18 are deflected, which causes a restoring spring force to be stored therein.

During this snapping movement of card 19 to the left, each masking tongue 20, which had previously taken on ready positions between two beam paths 32, momentarily blocks one path 32 completely so that the path of the light beam, which may be continuously emitted by a respective light source 46, e.g. a GaAs diode, is interrupted on its way toward the associated light receiver 47, e.g. a phototransistor. Since the leaf spring 43 is stronger than both spring bars 18 combined, the card 19 remains in its snapped position, which is delimited by abutment 24 and in which control tongue 25 takes on the position II of FIG. 2, as long as key element 1 remains depressed. In this snapped position, each tongue 20 is once again located between two beam paths 32.

When the key element 1 returns to its upper rest position after release of the associated button 17 and under the action of the return force of its film hinges 4 and 5, control tongue 25 of coding slide 19 comes to lie behind the protrusion 26 and slides upwardly along its vertical edge 48 which is oriented toward the left although leaf spring 43 has now again returned to its rest position and been sufficiently relaxed as a result of the return action of film hinge 37. Before reaching the upper rest position of key element 1, control tongue 25 passes through the position III shown in FIG. 2, where the masking tongues 20 of card 19 are again above the beam paths 32.

Upon leaving this position III, the control tongue 25 of card 19 is released from protrusion 26 and can snap back to the starting position shown in FIG. 1 due to the restoring spring force exerted by spring bars 18, the leaf spring 43 in the meantime having also taken on the rest position shown in FIG. 1.

Thus, during a complete actuating movement cycle, each masking tongue 20 passes across a respective light beam path 32 only once and this occurs at a speed determined by the spring forces exerted by springs 43 and 18 at a predetermined point in the actuation movement of key element 1, which point is preferably slightly above the end point of the key element travel path. Both the forward snap movement and the return movement of the code card 19 transmit a reaction effect to the associated key button 17 which can be tactually sensed by the operator.

It will be understood that the above description of the present invention is susceptible to various modifications, changes and adaptations, and the same are intended to be comprehended within the meaning and range of equivalents of the appended claims.

What is claimed is:

1. In a keyboard composed of a plurality of key elements arranged to be individually actuated, actuation sensing means composed of a plurality of light emitters producing light beams extending along parallel paths and a plurality of detectors each disposed at the end of a respective light beam path, a plurality of coded masks each associated with a respective key element and each movable into an operational position where said mask blocks at least one beam path to provide a selected pattern of light beam interruptions that identifies its associated key element, and drive means connected between each key element and its associated mask for moving its associated mask through its operational position in response to actuation of its associated key element, the improvement comprising, for each said mask: guide means secured to said mask; and stationary counterguide means cooperating with said guide means for causing said mask to be displaced from a rest position, under the action of said drive means in response to actuation of its associated key element, over a closed path having a first portion along which said mask moves through its operational position and a second portion which is displaced from said first portion.

2. An arrangement as defined in claim 1 wherein said drive means for each said key element and its associated mask comprise: connecting means for bringing said guide means into cooperative association with said counterguide means upon actuation of said key element; first spring means which are in a substantially relaxed state when said mask is in its rest position and which are stressed by movement of said mask over the first portion of said closed path to produce a force urging said mask back toward its rest position; and second spring means responsive to actuation of said key element for exerting an increasing force which drives said mask over the first portion of said closed path.

3. An arrangement as defined in claim 2 wherein: said connecting means and said first spring means are together constituted by two spring bars which extend in the actuation direction of said key element and are connected between said key element and said mask to form a parallelogram-type linkage with said mask which permits movement of said mask relative to said key element in a direction transverse to the actuation direction of said key element and movement of said mask substantially as a unit with said key element in the actuation direction; said second spring means are constructed to produce a stronger spring force than said first spring means upon actuation of said key element; said second spring means comprise a two-armed lever which is pivotally connected to said key element at a point between its arms, the arms of said lever including a first arm which extends transversely to the actuation direction of said key element; and a second arm having the form of a spring bar and extending substantially in the key actuation direction; said mask further includes a displacement tongue facing the free end of said second arm and engaged thereby upon actuation of said key element; and said keyboard further comprises a stationary support member supporting said first arm.

4. An arrangement as defined in claim 2 wherein said first and second spring means and said mask comprise integral parts of a one-piece component.

5. An arrangement as defined in claim 1 further comprising stationary means defining a plurality of guide grooves extending transverse to the light beam paths and each arranged to guide a respective mask during travel of its closed path, each said counterguide means for each said mask comprises a body of rectangular cross section protruding laterally from one wall of the guide groove for its associated mask, and said guide means for each said mask comprises a control tongue protruding laterally from its associated mask and located to be guided around said body of rectangular cross section under the action of said drive means.

6. An arrangement as defined in claim 1 further comprising means defining two stationary abutments, and positioning means on each said mask disposed to bear against a respective one of said abutments when said mask is at a respective end of said first portion of said closed path along which said mask is displaced.

7. An arrangement as defined in claim 1 wherein each said mask is manufactured to have a plurality of light-blocking tongues each of which would block a respective beam path when said mask is in its operational position, each said tongue being formed to have at its base a breakaway line along which it can be selectively broken off from said mask in accordance with the pattern of light beam interruptions to be produced by said mask.

8. An arrangement as defined in claim 1 wherein said keyboard is provided with a plurality of key buttons arranged in rows, each said key button being connected to a respective key element, and two stationary key element supports each disposed to a respective side of said rows, and each said key element comprises: a rigid body portion extending across all of the rows of key buttons; two bearing guides each supported by a respective one of said key element supports; and two film hinges each connecting a respective one of said bearing guides to a respective end of said rigid body portion for causing said rigid body portion to undergo a linear translational movement upon actuation of said key element.

9. An arrangement as defined in claim 8 wherein each said key element support defines a bearing recess and each said bearing guide includes a bearing tongue engaging in said bearing recess of its respective key element support, and further comprising means defining a key element abutment located between said key element supports and against which said key element bears when not actuated, said film hinge being constructed to exert a slight spring force urging said key element against said key element abutment when said key element is bearing thereagainst.

* * * * *